United States Patent [19]

Finkbeiner

[11] Patent Number: 4,838,486

[45] Date of Patent: Jun. 13, 1989

[54] SHOWER HEAD

[75] Inventor: Werner Finkbeiner, Schiltach, Fed. Rep. of Germany

[73] Assignee: Hans Grohe GmbH & Co. KG, Fed. Rep. of Germany

[21] Appl. No.: 165,757

[22] Filed: Mar. 9, 1988

[30] Foreign Application Priority Data

Mar. 12, 1987 [DE] Fed. Rep. of Germany ..... 3707885

[51] Int. Cl.[4] ..... B05B 15/02; B05B 1/18

[52] U.S. Cl. ..... 239/117; 239/381; 239/391; 239/447

[58] Field of Search ..... 239/114–117, 239/380–383, 390, 391, 392, 394, 436, 437, 443, 444, 446–449

[56] References Cited

U.S. PATENT DOCUMENTS

| | | | |
|---|---|---|---|
| 1,236,617 | 8/1917 | Speakman | 239/118 |
| 1,982,538 | 11/1934 | Reedy | 299/136 |
| 2,251,192 | 7/1941 | Krumsick et al. | 299/136 |
| 4,330,089 | 5/1982 | Finkbeiner | 239/381 |

FOREIGN PATENT DOCUMENTS

| | | |
|---|---|---|
| 377401 | 6/1923 | Fed. Rep. of Germany . |
| 520129 | 3/1931 | Fed. Rep. of Germany . |
| 711583 | 10/1941 | Fed. Rep. of Germany . |
| 804089 | 7/1949 | Fed. Rep. of Germany . |
| 936671 | 12/1955 | Fed. Rep. of Germany . |
| 2417831 | 1/1980 | Fed. Rep. of Germany . |
| 2911936 | 12/1982 | Fed. Rep. of Germany . |

*Primary Examiner*—Andres Kashnikow
*Assistant Examiner*—Karen B. Merritt
*Attorney, Agent, or Firm*—Steele, Gould & Fried

[57] ABSTRACT

A shower head contains two shower devices, which can be alternately operated with the aid of a changeover device. One shower device contains a row of shower holes. On switching from the first to the second shower device, a pin is inserted in each shower hole and has approximately the same diameter as the shower hole. Thus, during each changeover, there is a cleaning of the shower hole from the inside, which leads to a removal of deposits and contamination.

12 Claims, 3 Drawing Sheets

SHOWER HEAD

The invention relates to a shower head with a first shower device having a plurality of shower holes, as well as with a plurality of pins arranged in the extension of the shower holes and whose diameter is adapted to that of the latter and which are displaceably constructed for penetrating and passing through the shower holes.

BACKGROUND

A shower is known (German Pat. No. 804 809), in which a displaceable plate is arranged within the shower head and which is forwardly displaceable from the rear of the said head. Pins fitted to the plate pass from the inside through the shower holes in the front of the shower. This displaceable plate is intended to clean rust and cinder particles from the shower holes. However, cleaning requires manual activity, so that it cannot be ensured that the cleaning device is actually used.

A shower device is also known (German Pat. No. 711 583), in which a displaceable plate is arranged within the shower head and which is moved forwards under the pressure of the water. The displaceable plate has pins which, in the inoperative position, already engage in the shower holes and in the case of water pressure pass through the same, so that in this way a jet is formed. The pins have a smaller diameter than the holes.

OBJECTS AND SUMMARY OF THE INVENTION

The problem of the invention is to provide a shower head, in which deposits, particularly calcareous deposits are cleaned from the shower holes in a frequent manner and at regular intervals, without the user having to do anything.

According to the invention this problem is solved in that the shower head has a second shower device operable alternatively or additionally to the first and for changing between the two shower devices a changeover device is provided which, on changing from the first to the second shower device moves the pins into or through the shower holes of the first shower device. Showers having the most varied shower devices with different jet forms are known. In this case, the user brings about frequent changes as a function of the desired jet means, so that according to the invention in each case the shower holes of the first shower device are automatically cleaned on changing over. This is done without the user having to do anything and he does not even see that the event is taking place.

For example, it is conceivable for the second shower device to be constructed in exactly the same way as the first, i.e. to also have shower holes with pins arranged in its extension. Thus, in this case there would be an alternate cleaning of the two shower devices. However, it is also possible for the second shower device to have a different jet form, e.g. it can have a highly ventilated or so-called soft jet. However, the invention can still be used if, according to the invention, a third shower device is provided on the shower head, e.g. a massage jet.

According to the invention, with the second and optionally third shower device switched in, the changeover device is constructed in such a way that the pins are then arranged in the shower holes of the first shower device. The changeover device can be advantageously arranged and constructed in such a way that the pins are actuated on changing from one shower device into the other. For example, it is possible at one end of the adjustment path of the actuator to actuate the second shower device and at the opposite end the third shower device, the first shower device with the pins being in the centre. Cleaning can then take place automatically in both end positions.

According to a further development the shower holes of the first shower device are in the form of long, blind hole-like bores, which are tapered in their outlet area and in the inoperative state the pins penetrate into the non-tapered area. Thus, an annular clearance is formed for the water flow in the initial area of the bores and prevents the penetration of larger particles. It is also possible in this way that when this shower device is not operating, the water is drawn back somewhat out of the holes as a result of capillary action, so that the risk of calcification is reduced.

According to the invention the changeover device has a rotary element and the pins are fixed to a ring, which is axially displaceable on rotating the actuator. It is naturally also possible for the ring to be rotatable together with the element containing the shower holes and then the rotation is accompanied by a displacement.

The movement of the ring or any other pin-carrying element can take place through a connecting link guide or a slot cooperating with a counterelement. This type of movement of the pins can be achieved by a corresponding construction of the slot or the connecting link guide. For example, the slot can be shaped like a V or a W.

BRIEF DESCRIPTION OF THE DRAWINGS

Further features, details and advantages of the invention can be gathered from the following description of a preferred embodiment and the attached drawings, wherein show.

DETAILED DESCRIPTION

Figure 1:
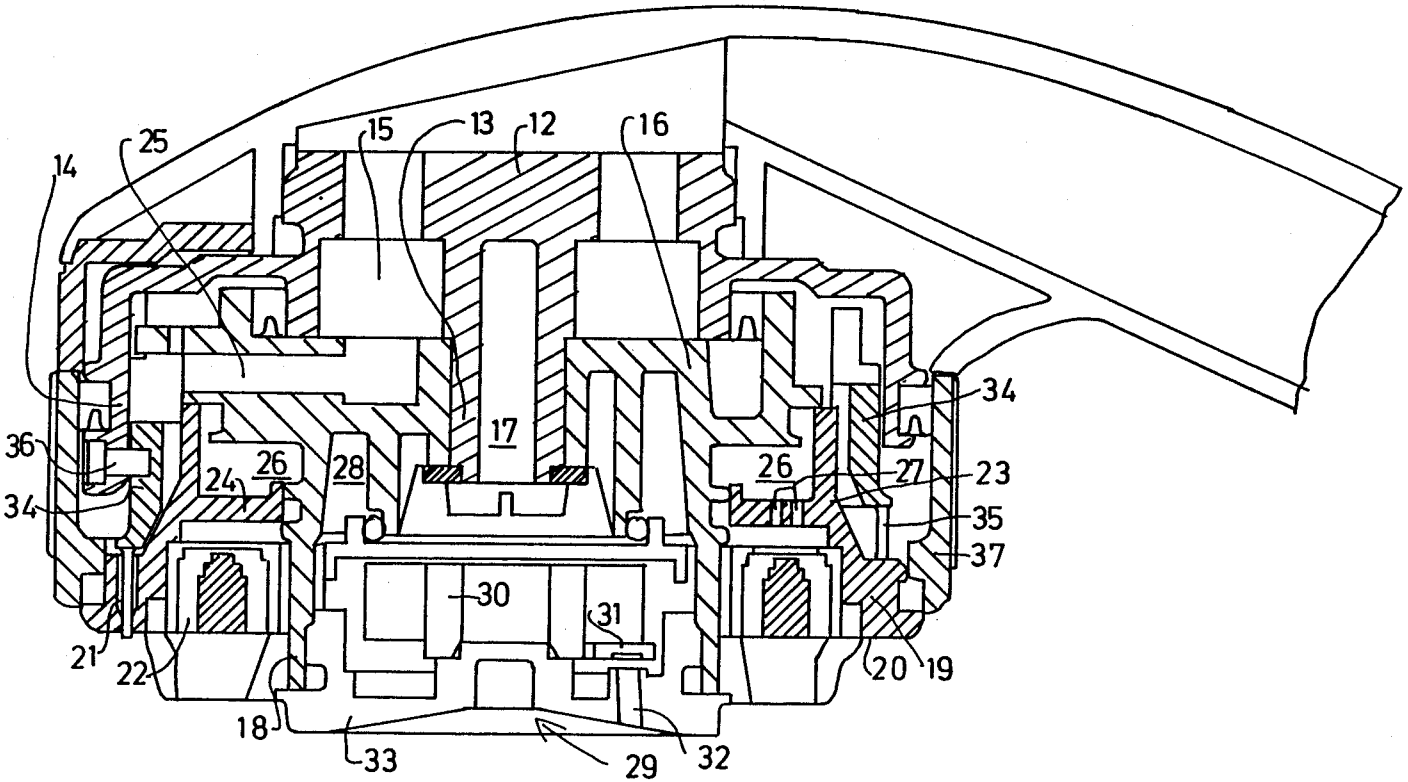
FIG. 1: A diagrammatic cross-section through a shower head according to the invention.

The shower head of FIG. 1 contains a gripping element 11 a screwed-in central part 12, which has a central, extended bearing attachment 13 and a concentric, outer skirt 14. The central part has two axial water passages 15 parallel to the bearing attachment 13. On the bearing attachment 13 is mounted a rotary slide valve 16, which is secured with the aid of a screw 17. Concentrically to its rotation axis, the rotary slide valve 16 contains a skirt 18, which extends to the underside of the shower head. Outside the skirt 18, a shower base 19 is connected in non-rotary manner to the rotary slide valve 16 and has within its axial underside 20 two shower devices, namely in the border region a row of shower holes 21 and concentric thereto a row of openings 22 for ventilated water jets. These two rows of shower holes 21 or openings 22 are separated by an approximately cylindrical wall 23 having on its inside and roughly at half its height an inwardly directed flange 24, whose inside engages on the rotary slide valve 16.

The rotary slide valve 16 contains several passages, whereof only a single passage 25 can be seen in FIG. 1. In the represented position, the said passage 25 is connected to the water inflow and passes this water through openings 15 outward to the outside of wall 23. The water can flow here along the outside through the shower holes 21 into the open.

On rotating the rotary slide valve 16 openings 15 coincide with the other passages, whereof one leads into the space 26 above flange 24. Space 26 extends as a ring around the rotation axis of the rotary slide valve 16 formed by screw 17. Flange 24 has individual small holes 27, which carry the water to the openings 22 for the ventilated jet.

On further rotating the rotary slide valve 16, it passes into a position in which the water can pass through a further passage into the area 28 within skirt 18 and from there flows to a third shower device 29, which in the represented embodiment produces a massage jet. For this purpose a rotor 30 is provided, which alternately opens and closes openings 32 in end plate 33 by means of a valve plate 31. The rotor is rotated by the laterally inflowing water.

A ring 34 is connected in non-rotary manner with the wall 23 in the vicinity of the outside thereof, said wall separating the first from the second shower device. This ring is displaceably arranged in the axial direction of bearing attachment 13. In the left-hand half of FIG. 1, ring 34 is shown in its one axial end position, whilst in the right-hand half it is shown in the opposite axial end position.

Ring 34 contains on its underside a row of cylindrical pins 35, whereof each pin 35 is located in the extension of a shower hole 21 of shower base 19. In the right-hand position in FIG. 1, pin 35 engages in shower hole 21.

A total of three studs 36 are circumferentially distributed over the outer skirt 14 of central part 12 of the shower head and engage in a slot shaped into the outside of ring 34. If the rotary slide valve is rotated with the aid of the outer gripping ring 37 and consequently the water is switched over to one of the three shower devices, then simultaneously ring 34 with the shower base 19 is rotated. As a function of the position of the slot in which the studs 36 engage, it is possible to bring about a simultaneous axial displacement of ring 34 and consequently pins 35, which are then introduced into the shower holes 21 until they project slightly over the underside 20 of shower base 19.

Figure 2:
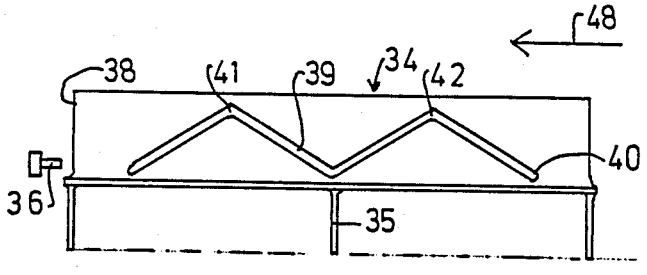
FIG. 2: A diagrammatic side view of a first cleaning element provided with pins.

FIG. 2 is a diagrammatic side view of ring 34 with the pins 35 arranged on its underside, only some of these pins being shown for simplification reasons. Three zigzag slots 39 are shaped into the outside 38 of ring 34, but only one can be seen in FIG. 2. Slot 39 cooperates with the stud 36 in the outer skirt 14 of central part 12, said stud being diagrammatically shown to the left. The ends 40 of slot 39 correspond to the position in which the pins 35 have been retracted as far as possible out of the shower holes 21. In this position of the rotary slide valve 16 the water flows through the shower holes 21 of the first shower device. If gripping ring 37 is now rotated, then stud 36 engages on the lateral edges of slot 39 and moves ring 34 in FIG. 2 downwards, so that the pins 35 are introduced into shower holes 21. The arrangement of slot 39 is such that the first tip 41 of slot 39 from the left corresponds to the position in which the second shower device is fully connected in, i.e. in the example of FIG. 1 the openings 22 for the ventilated jet. In this position the pins 35 are introduced into the shower holes 21 to the maximum extent. On further rotating ring 34 in the direction of arrow 42 in FIG. 2, subsequently ring 34 is again axially moved in such a way that the pins 35 are drawn out of the shower holes 21. The following tip 42 of slot 39 corresponds to the connected-in third shower device, i.e. the massage shower 29. Thus, on switching from the second to the third shower device and back again, pins 35 are on each occasion drawn out and then reinserted into the shower holes 21.

Figure 3:
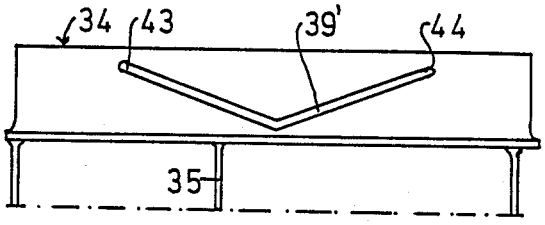
FIG. 3: A side view of another cleaning element.

This also applies for the embodiment of ring 34' according to FIG. 3, in which the slot 39' is V-shaped. In one end region 43 of slot 39' the second shower device is fully operating and pins 35 are fully inserted into the shower holes 21. In the opposite end region 44 of slot 39' the third shower device is connected in and pins 35 are also completely introduced into the shower holes 21. In the intermediate region pins 35 are withdrawn from the shower holes 21 and the first outer shower device is connected in. Thus, the cleaning of the shower holes 21 of the first shower device takes place automatically on each changeover of the shower without the user noticing it.

Figure 4:
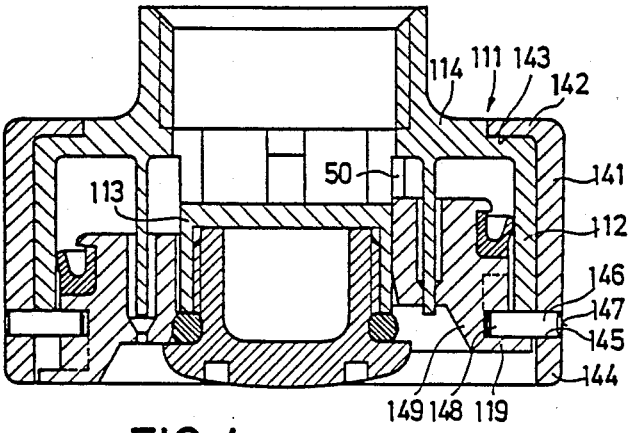
FIG. 4: A section through a shower head with a curved guide.

In the embodiment according to FIG. 4 a rotary sleeve 141 is placed over the outer wall 112 of casing 111. Rotary sleeve 141 engages with an inwardly directed shoulder 142 into a corresponding, upwardly open recess 143 of the top of end wall 114 of casing 111. Therefore the outside of rotary sleeve 141 is flush with the outside of casing 111. The inside of rotary sleeve 141 engages on the entire outside of outer wall 112, so that there is a flat engagement. In its lower region 144 adjacent to the jet disk 119, rotary sleeve 141 has two holes 145 with a pin 146 inserted in each of them. The outsides 147 of pins 146 do not project over the outside of rotary sleeve 141. Pins 146 project with their inner ends 148 into slits 149, which are shaped into the cylindrical outside of the jet disk 119. The shape of the slits can be gathered from FIG. 5. On the outside of the cylindrical inner attachment 113 of the shower head casing 111 are formed ribs 50, which engage in corresponding, invisible slots on the inside of the jet disk 119. Thus, rotation of the jet disk is prevented whilst it is axially displaceable. To the left of FIG. 4 it is possible to see the release position of the jet disk 119, whilst the opposite end position is shown to the right in FIG. 4.

Figure 5:
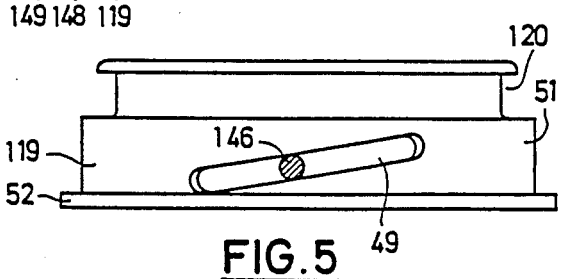
FIG. 5: A view of the jet disk of the embodiment of FIG. 4 from the side.

FIG. 5 is a side view of the jet disk 119 of the embodiment of FIG. 4. The aforementioned slit 149 is shaped into the outside 51 of jet disk 119. This slit slopes slightly with respect to the transverse axis of jet disk 119 and has a constant width. Pin 146 visible in FIG. 4 engages in the slit in such a way that its two sides rest against the longitudinal edges of slit 149. Since, as a result of the cooperation of ribs 50 and the slots, jet disk 119 is prevented from rotating, a rotation of rotary sleeve 141 leads to the jet disk 119 being moved upwards or downwards. If pin 146 is moved to the left through rotary sleeve 141 in FIG. 5, then there is an upward movement of jet disk 119, whilst a displacement of pin 146 to the right leads to a downward movement of the jet disk 119.

In the embodiment according to FIGS. 4 and 5, jet disk 119 has a lower outer flange 52, which covers the lower edge of the cylindrical outer wall 112 of casing 111.

Figure 6:
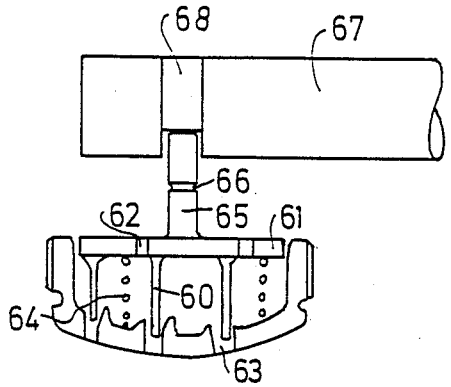
FIGS. 6 to 8: Further embodiments of the invention.
Figure 7:
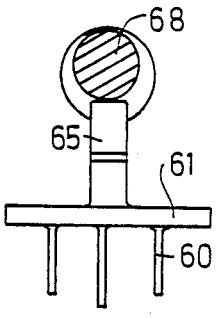

Within the embodiment of FIG. 6 and 7 the pins 60 are formed in one piece on a plate 61, which plate has openings 62 through which the flowing water can pass. The pins 60 cooperate with openings 63 from which the water may leave the shower head. The plate 61 is biased by a pressure spring 64 in a direction in which the pins 60 are retracted out of the holes 63. On the upper side of plate 62 a lug 65 is formed which has a circular groove 66 for receiving a seal.

A cross extending shaft 67 serves to adjust the plate 61. The shaft 67 is configured excentrical in its portion 68 which cooperates with the lug 65. The upper side of the lug 65 engages this excentrical portion 68. By rotating the shaft 67 the plate 61 is moved reciprocally in the direction of the holes 63.

Figure 8:
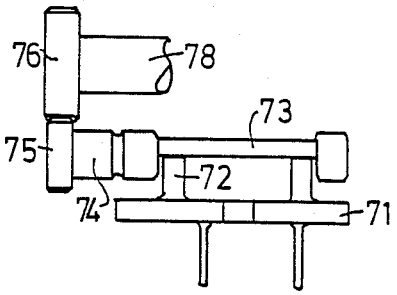

Concerning the embodiment of FIG. 8 on the upper side of the plate 71 are configured two lugs 72 which cooperate similarly with an intermediate excentrical portion 73 of an adjusting shaft 74. The shaft 74 has a gear wheel which meshes with a gear wheel 76 of the shaft 78.

I claim:

1. A shower head, comprising:

a first shower device having a first plurality of shower holes (21), as well as with a plurality of pins (35) arranged along an extension of the first shower holes (21), the pins having a diameter that corresponds to that of the first shower holes (21), one of said pins (35) and an element containing the first shower holes (21) being constructed so as to be displaceable relative to the other of said pins (35) and said element containing the first shower holes (21), thereby to permit the pins (35) to penetrate into and pass through the first shower holes (21);

a second separate shower device having a second plurality of shower holes separate from the first shower holes of the first shower device, the second shower device being operable apart from operation of the first shower shower device; and, a changeover device for changing between the two shower devices and which on changing from the first to the second shower device moves the pins (35) into the first shower holes (21) of the first shower device.

2. Shower head according to claim 1, wherein a third separate shower device (29) is provided.

3. Shower head according to claims 1 or 2, wherein when the second and optionally the third shower device (29) is operational, the pins (35) are arranged in the first shower holes (21) of the first shower device.

4. Shower head according to claim 2, wherein on changing from the first shower device into each of the other shower devices, the pins (35) are actuated.

5. Shower head according to claim 1, wherein the first shower holes (21) of the first shower device are in the form of long bores tapered in the outlet area and in the inoperative state pins (35) extend into the non-tapered areas of the bores.

6. A shower head, comprising:

a first shower device having a plurality of shower holes (21) and a plurality of pins (35) arranged in an extension of the shower holes (21), the pins having a diameter corresponding to the shower holes, at least one the pins (35) and an element containing the shower holes (21) being constructed so as to be displaceable relative to the other, thereby causing the pins (35) to penetrate into an pass through the shower holes (21); and, a second shower device operable apart from a first shower device; and, a changeover device for changing between the first shower device and the second shower device, and which on changing from the first to the second shower device causes the pins (35) to be moved into the shower holes (21) of the first shower device, the changeover device having a rotary element (37) and the pins (35) being fixed to a ring (34) which is axially displaceable on rotating the rotary element (37).

7. Shower head according to claim 6, wherein the ring (34) is moved with the aid of a stud (36) engaging in a sloping slot (39, 39').

8. Shower head according to claim 7, wherein the slot (39, 39') is in the shape of a V or W.

9. Shower head according to claims 7 or 8, wherein the slot (39, 39') is constructed in ring (34).

10. A shower head, comprising:

a first shower device having a plurality of shower holes (21) and a plurality of pins (35) arranged along an extension of the shower holes (21), the pins having a diameter closely matching that of the shower holes (21), at least one of the pins (35) and an element containing the shower holes (21) being displaceable relative to one another to thereby cause the pins (35) to penetrate into and pass through the shower holes (21); and, further comprising a jet disk (119) defining the shower holes, the jet disk being made displaceable with respect to the pins by an acutator.

11. Shower head according to claim 10, wherein the actuator is a rotary ring which, by means of a connecting link guide leads to a displacement of the pins held in non-rotary manner.

12. Shower head according to claims 10 or 11, further comprising a casing of the shower head and wherein the pins (149) are fixed to the casing.

* * * * *

UNITED STATES PATENT AND TRADEMARK OFFICE

CERTIFICATE OF CORRECTION

PATENT NO. : 4,838,486

DATED : June 13, 1989

INVENTOR(S) : Finkbeiner, et al.

It is certified that error appears in the above-identified patent and that said Letters Patent is hereby corrected as shown below:

Column 6, line 14 delete "an" and insert --and--.

Signed and Sealed this

Twenty-eighth Day of May, 1991

*Attest:*

HARRY F. MANBECK, JR.

*Attesting Officer*

*Commissioner of Patents and Trademarks*